US009022590B2

(12) United States Patent
Chen et al.

(10) Patent No.: US 9,022,590 B2
(45) Date of Patent: May 5, 2015

(54) LUMINOUS KEYBOARD DEVICE

(71) Applicant: Primax Electronics Ltd., Neihu, Taipei (TW)

(72) Inventors: Chung-Yuan Chen, Taipei (TW); Hsuan-Wei Ho, Taipei (TW)

(73) Assignee: Primax Electronics Ltd., Taipei (TW)

( * ) Notice: Subject to any disclaimer, the term of this patent is extended or adjusted under 35 U.S.C. 154(b) by 134 days.

(21) Appl. No.: 13/956,510

(22) Filed: Aug. 1, 2013

(65) Prior Publication Data

US 2014/0340866 A1 Nov. 20, 2014

(30) Foreign Application Priority Data

May 17, 2013 (TW) ..... 102117546 A

(51) Int. Cl.
*G01D 11/28* (2006.01)
*H01H 13/83* (2006.01)

(52) U.S. Cl.
CPC ..... *H01H 13/83* (2013.01)

(58) Field of Classification Search
USPC ..... 362/23.03, 602, 607, 23.05, 23.07, 362/23.09, 23.1, 23.12, 23.14, 23.16, 23.17, 362/610, 615, 617, 621, 628, 633; 341/22, 341/33, 31; 200/5 A, 310, 314, 344
See application file for complete search history.

(56) References Cited

U.S. PATENT DOCUMENTS

| | | | | |
|---|---|---|---|---|
| 5,304,764 | A * | 4/1994 | Kobayashi | 200/314 |
| 8,534,853 | B2 * | 9/2013 | Ligas et al. | 362/23.03 |
| 2006/0139905 | A1 * | 6/2006 | Kao et al. | 362/23 |
| 2008/0273318 | A1 * | 11/2008 | Chou | 362/85 |
| 2009/0067153 | A1 * | 3/2009 | Takeda et al. | 362/85 |
| 2010/0123606 | A1 * | 5/2010 | Nishino | 341/22 |
| 2014/0133126 | A1 * | 5/2014 | Tsai | 362/23.03 |

* cited by examiner

*Primary Examiner* — Thomas A Hollweg
*Assistant Examiner* — Kevin Quarterman
(74) *Attorney, Agent, or Firm* — Kirton McConkie; Evan R. Witt

(57) ABSTRACT

A luminous keyboard device includes plural keys, a light-emitting element, and a light guide plate. By the light guide plate, a light beam emitted by the light-emitting element is guided to the plural keys. The light guide plate includes plural elongated slots and a light-absorbing part. The plural elongated slots are located near a lateral edge of the light guide plate. After the light beam transferred within the light guide plate is transmitted through the elongated slots and departed from the light guide plate, the fraction of the light beam introduced into the lateral edge of the light guide plate is reduced. The light-absorbing part is located at the lateral edge of the light guide plate for absorbing the portion of the light beam which is introduced into the lateral edge of the light guide plate. Consequently, the lateral light leakage of the light guide plate can be avoided.

11 Claims, 8 Drawing Sheets

LUMINOUS KEYBOARD DEVICE

FIELD OF THE INVENTION

The present invention relates to a keyboard device, and more particularly to a luminous keyboard device.

BACKGROUND OF THE INVENTION

Generally, the widely-used peripheral input device of a computer system includes for example a mouse device, a keyboard device, a trackball device, or the like. Via the keyboard device, characters and symbols can be inputted into the computer system directly. As a consequence, most users and most manufacturers of input devices pay much attention to the development of keyboard devices.

FIG. 1 is a schematic top view illustrating the outer appearance of a conventional keyboard device. As shown in FIG. 1, there are plural keys 10 on a surface of the conventional keyboard device 1. These keys 10 are classified into several types, e.g. ordinary keys 101, numeric keys 102 and function keys 103. When one of these keys 10 is depressed by the user's finger, a corresponding signal is issued to the computer, and thus the computer executes a function corresponding to the depressed key. For example, when an ordinary key 101 is depressed, a corresponding English letter or symbol is inputted into the computer. When a numeric key 102 is depressed, a corresponding number is inputted into the computer. In addition, the function keys 103 (F1~F12) can be programmed to provide various functions. For example, the conventional keyboard device 1 is a keyboard device for a notebook computer.

With the maturity of the computing technologies, the keyboard manufacturers make efforts in designing novel keyboard devices with special functions in order to meet diversified requirements of different users. For this reason, a luminous keyboard device has been introduced into the market. The outer appearance of the conventional luminous keyboard device is substantially similar to the outer appearance of the conventional keyboard device 1. Since the luminous keyboard device provides the function of illuminating the keys, the inner structure of the luminous keyboard device is different from the inner structure of the keyboard device without the illuminating function. Hereinafter, the inner structure of the luminous keyboard device will be illustrated in more details. FIG. 2 is a schematic cross-sectional view illustrating a conventional luminous keyboard device. As shown in FIG. 2, the conventional luminous keyboard device 2 comprises plural keys 20, a membrane switch circuit member 21, a light guide plate 22, a backlight module 23, a supporting plate 24, a reflecting plate 25, and a base 26. Each key 20 comprises a keycap 201, a scissors-type connecting element 202 and an elastic element 203. From top to bottom, the keycap 201, the scissors-type connecting element 202, the elastic element 203, the membrane switch circuit member 21, the supporting plate 24, the light guide plate 22, the reflecting plate 25 and the base 26 of the conventional luminous keyboard device 2 are sequentially shown. The backlight module 23 is located at a side of the membrane switch circuit member 22. For example, the conventional luminous keyboard device 2 is a keyboard device of a notebook computer (not shown), and the base 26 is installed on the notebook computer.

In the key 20, the keycap 201 is exposed outside the conventional luminous keyboard device 2, so that the keycap 201 can be depressed by the user. The scissors-type connecting element 202 is used for connecting the keycap 201 and the supporting plate 24. The elastic element 203 is penetrated through the scissors-type connecting element 202. In addition, both ends of the elastic element 203 are contacted with the keycap 201 and the membrane switch circuit member 21, respectively. The membrane switch circuit module 21 comprises an upper wiring board 211, a spacer layer 212, and a lower wiring board 213. The upper wiring board 211, the spacer layer 212 and the lower wiring board 213 are all made of a light-transmissible material. The light-transmissible material is for example polycarbonate (PC) or polyethylene (PE). The upper wiring board 211 has plural upper contacts 2111. The spacer layer 212 is disposed under the upper wiring board 211, and comprises plural perforations 2121 corresponding to the plural upper contacts 2111. The lower wiring board 213 is disposed under the spacer layer 212, and comprises plural lower contacts 2131 corresponding to the plural upper contacts 2111. The plural lower contacts 2131 and the plural upper contacts 2111 are collectively defined as plural key switches 214.

The backlight module 23 comprises an illumination circuit board 231 and plural light-emitting elements 232. For clarification and brevity, only two light-emitting elements 232 are shown in the drawing. The illumination circuit board 231 is disposed under the membrane switch circuit member 21 for providing electric power to the plural light-emitting elements 232. The plural light-emitting elements 232 are disposed on the illumination circuit board 231, and respectively inserted into plural reflecting plate openings 251 of the reflecting plate 25 and plural light guide plate openings 221 of the light guide plate 22. By acquiring the electric power, the plural light-emitting elements 232 are driven to emit plural light beams B. Moreover, the plural light beams B are directed to the light guide plate 22. For example, the plural light-emitting elements 232 are side-view light-emitting diodes. The light guide plate 22 is used for guiding the plural light beams B to the keycaps 201. As shown in FIG. 2, the supporting plate 24 is arranged between the membrane switch circuit member 21 and the light guide plate 22 for supporting the keycap 201, the scissors-type connecting element 202, the elastic element 203 and the membrane switch circuit member 21. The reflecting plate 25 is disposed under the light guide plate 22 for reflecting the plural light beams B. Consequently, the plural light beams B are directed upwardly, and the utilization efficiency of the light beams B is enhanced. The two lateral edges 252 of the reflecting plate 25 are bent upwardly to enclose plural lateral edges 222 of the light guide plate 22. For clarification and brevity, only one lateral edge 252 of the reflecting plate 25 is shown in the drawing. Due to the lateral edges 252 of the reflecting plate 25, the problem of causing light leakage through the lateral edges 222 of the light guide plate 22 will be eliminated.

In the conventional luminous keyboard device 2, each keycap 201 has a light-outputting zone 2011. The light-outputting zone 2011 is located at a character region or a symbol region of the keycap 201. Moreover, the position of the light-outputting zone 2011 is aligned with a corresponding light-guiding dot 223 of the light guide plate 22. The light beam can be guided upwardly to the light-outputting zone 2011 through the corresponding light-guiding dot 223, thereby illuminating the character region or the symbol region of the keycap 201. Consequently, the illuminating function is achieved.

Please refer to FIG. 2 again. The base 26 comprises plural fixing protrusion posts 261. The plural fixing protrusion posts 261 are integrally formed with the base 26. Moreover, the light guide plate 22 further comprises plural first fixing holes 224 corresponding to the plural fixing protrusion posts 261, respectively. The reflecting plate 25 further comprises plural second fixing holes 253 corresponding to the plural first fixing holes 224, respectively. For installing the light guide plate 22 and the reflecting plate 25 on the base 26, the plural fixing protrusion posts 261 are sequentially penetrated through the corresponding second fixing holes 253 and the corresponding first fixing holes 224. Consequently, the light guide plate 22 and the reflecting plate 25 are fixed on the base 26.

FIG. 3 is a schematic top view illustrating the light guide plate of the conventional luminous keyboard device of FIG. 2. Since the light guide plate 22 has the plural first fixing holes 224, some drawbacks may occur. For example, when the plural light beams B are transferred through the light guide plate 22 and transmitted through the plural first fixing holes 224, plural shadow regions 27 are created at the positions near the plural first fixing holes 224. Due to the plural shadow regions 27, the keys 20 of the conventional luminous keyboard device 2 fail to be uniformly illuminated. In addition to the first fixing holes 224, the light guide plate 22 may further comprise other holes such as ventilation holes (not shown) or sound holes (not shown). Similarly, plural shadow regions 27 are created at the positions near the ventilation holes and the sound holes of the light guide plate 22.

Recently, the general trends in designing electronic devices are toward slimness. In other words, the conventional luminous keyboard device needs to meet the requirements of slimness. Consequently, a luminous keyboard device without a reflecting plate has been introduced into the market, wherein a reflective ink layer is coated on a bottom surface of the light guide plate to replace the reflecting plate. Since the thickness of the reflective ink layer is usually smaller than the thickness of the general reflecting plate, the overall thickness of the luminous keyboard device is reduced. However, since the lateral edge of the light guide plate is too thin, it is difficult to install the reflective ink layer on the lateral edge of the light guide plate. That is, the reflective ink layer can be disposed on the bottom surface of the light guide plate only. Under this circumstance, the light beam may be leaked out through the lateral edge of the light guide plate. Therefore, there is a need of providing a luminous keyboard device with slimness and capable of avoiding lateral light leakage.

SUMMARY OF THE INVENTION

The present invention provides a luminous keyboard device with slimness and capable of avoiding lateral light leakage.

In accordance with an aspect of the present invention, there is provided a luminous keyboard device. The luminous keyboard device includes a base, plural keys, at least one light-emitting element, and a light guide plate. The plural keys are disposed over the base, and exposed outside a top surface of the luminous keyboard device. Each of the keys includes a light-outputting zone. The at least one light-emitting element is arranged between the base and the plural keys for emitting at least one light beam. The light guide plate is disposed on the base and located at a side of the at least one light-emitting element for guiding the at least one light beam to the plural light-outputting zones of the plural keys. The light guide plate includes plural holes, plural elongated slots, and at least one light-absorbing part. The plural elongated slots are located near a lateral edge of the light guide plate. After the light beam is transferred within the light guide plate and transferred to the elongated slots, a portion of the light beam is transmitted through the elongated slots and departed from the light guide plate. The at least one light-absorbing part is located at the lateral edge of the light guide plate. When the light beam is incident into the lateral edge of the light guide plate, the light beam is absorbed by the light-absorbing part.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For overcoming the drawbacks of the conventional luminous keyboard device, the present invention provides an improved luminous keyboard device.

Figure 1:
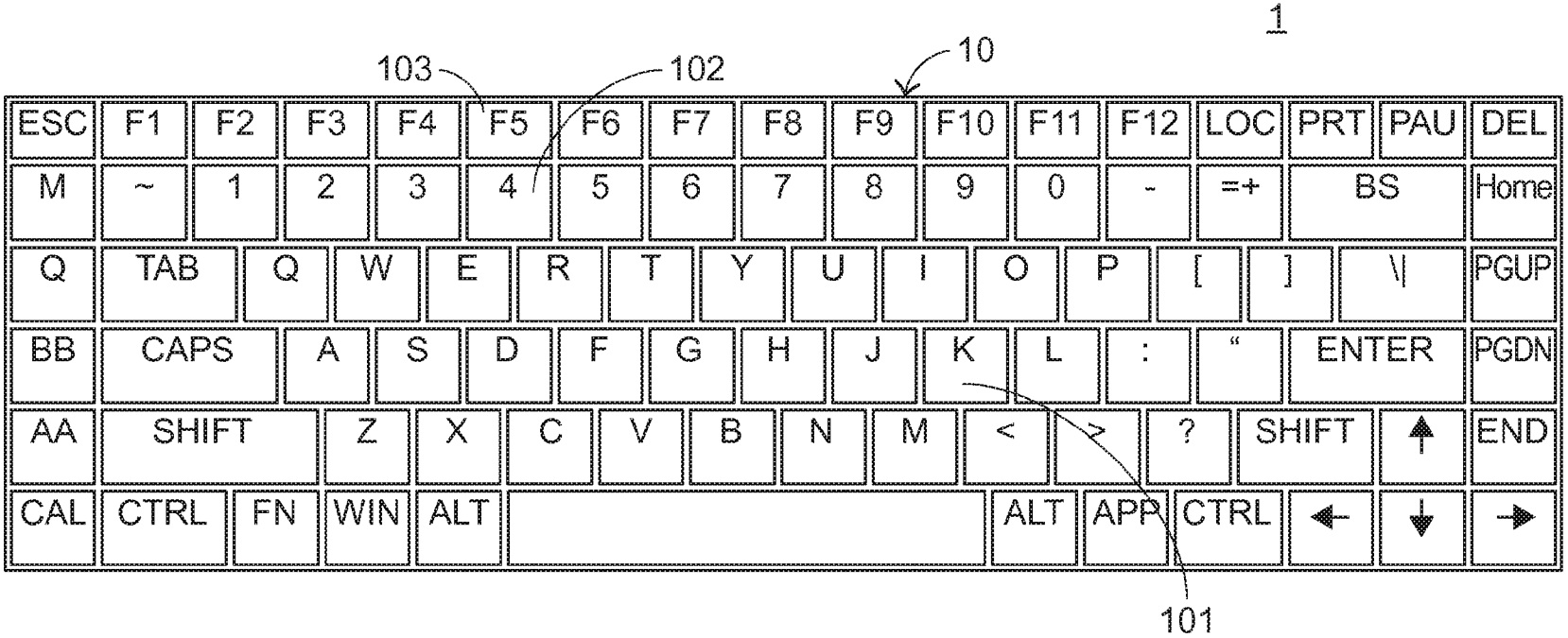
FIG.1 PRIOR ART
FIG. 1 is a schematic top view illustrating the outer appearance of a conventional keyboard device.
Figure 2:
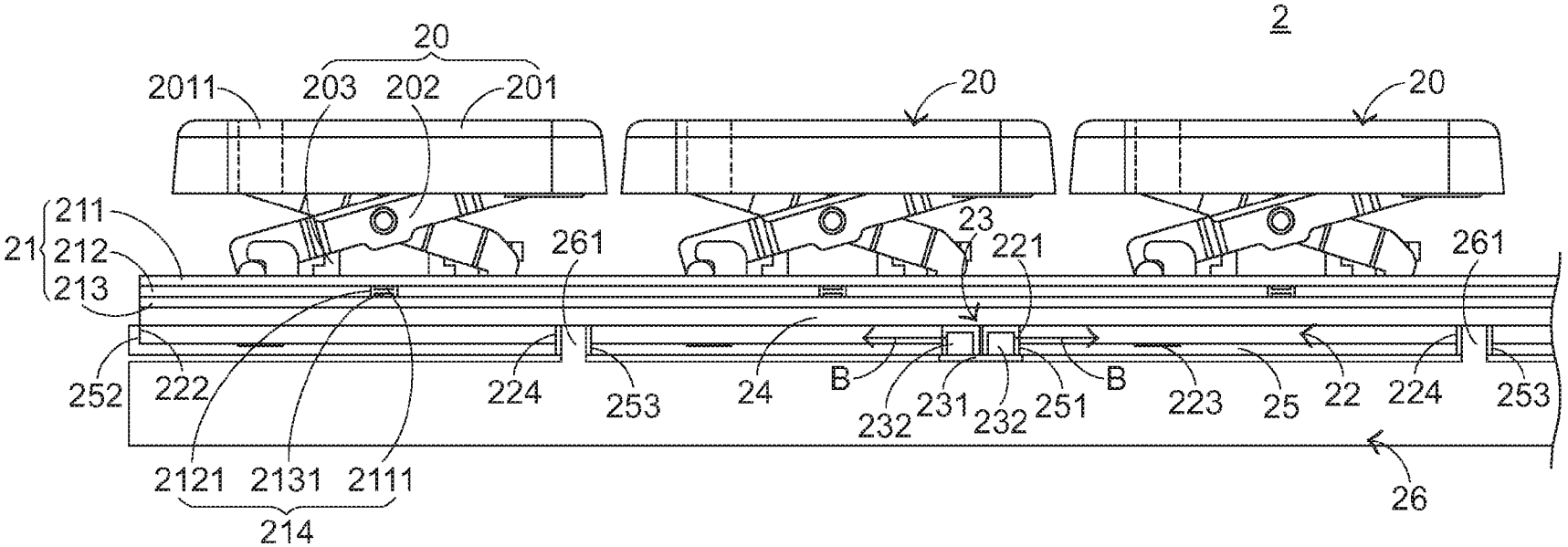
FIG.2 PRIOR ART
FIG. 2 is a schematic cross-sectional view illustrating a conventional luminous keyboard device.
Figure 3:
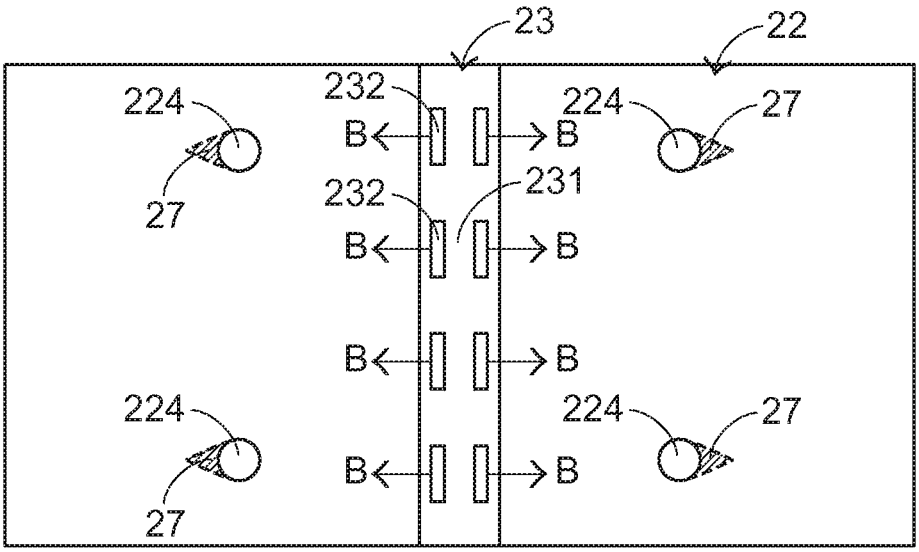
FIG. 3 is a schematic top view illustrating the light guide plate of the conventional luminous keyboard device of FIG. 2.
Figure 4:
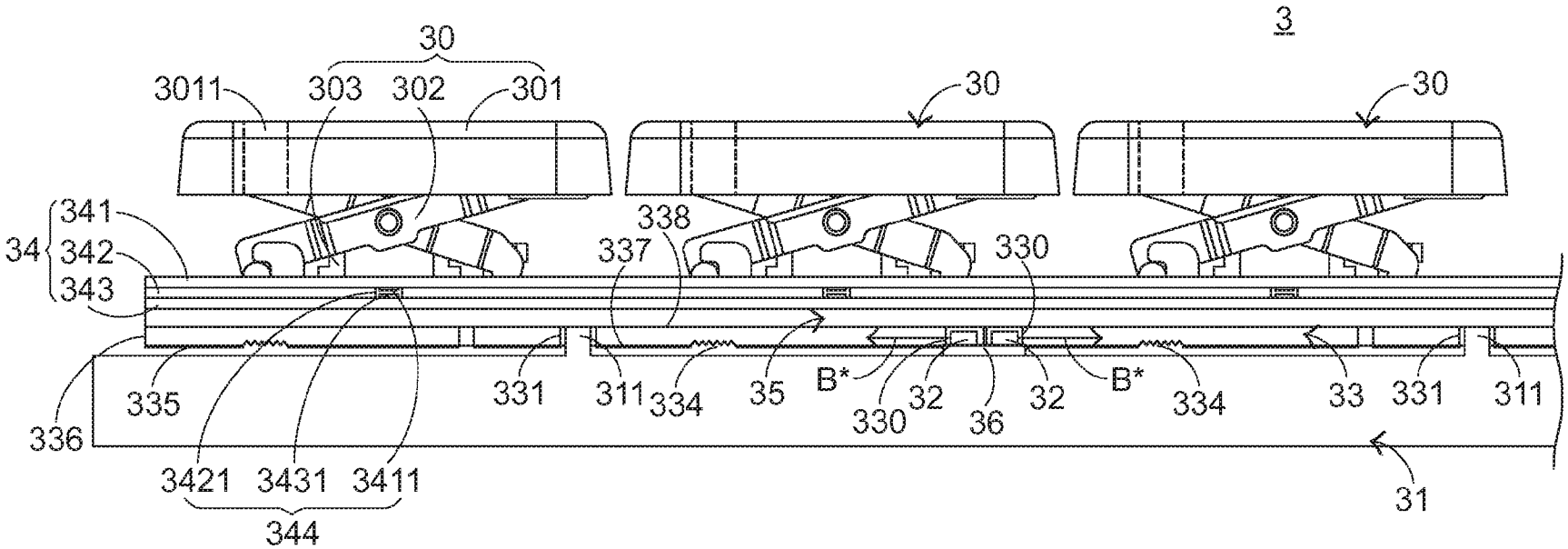
FIG. 4 is a schematic cross-sectional view illustrating a luminous keyboard device according to a first embodiment of the present invention.

FIG. 4 is a schematic cross-sectional view illustrating a luminous keyboard device according to a first embodiment of the present invention. As shown in FIG. 4, the luminous keyboard device 3 comprises plural keys 30, a base 31, plural light-emitting elements 32, a light guide plate 33, a membrane switch circuit member 34, a supporting plate 35, and an illumination circuit board 36. For clarification and brevity, only two light-emitting elements 32 are shown in the drawing. The base 31 comprises plural fixing structures 311. The plural fixing structures 311 are protruded upwardly from the base 31. The plural keys 30 are disposed over the base 31, and exposed outside a top surface of the luminous keyboard device 3. Each key 30 comprises a keycap 301, a connecting element 302, and an elastic element 303. The keycap 301 is exposed outside the top surface of the luminous keyboard device 3. Moreover, the keycap 301 has a light-outputting zone 3011. The connecting element 302 is arranged between the supporting plate 35 and the keycap 301. The connecting element 302 is used for connecting the supporting plate 35 and the keycap 301 and allowing the keycap 301 to be moved upwardly or downwardly relative to the supporting plate 35. The elastic element 303 is arranged between the membrane switch circuit member 34 and the keycap 301 for providing an elastic force to the keycap 301. In response to the elastic force, the keycap 301 is returned to an original position. In this embodiment, the luminous keyboard device 3 is a keyboard device for a notebook computer (not shown). Moreover, the fixing structures 311 are fixing protrusion posts, and the fixing structures 311 are integrally formed with the base 31. Moreover, the base 31 is installed on the notebook computer, the connecting element 302 is a scissors-type connecting element, and the elastic element 303 is a rubbery elastomer.

The supporting plate 35 is disposed under the membrane switch circuit member 34 and connected with the plural connecting elements 302 for supporting the plural keys 30. The plural light-emitting elements 32 are arranged between the base 31 and the plural keys 30 for emitting plural light beams B*. The light guide plate 33 is disposed on the base 31 for guiding the plural light beams B* to the plural light-outputting zones 3011 of the plural keys 30. The illumination circuit board 36 is disposed under the light guide plate 33, and the plural light-emitting elements 32 are disposed on the illumination circuit board 36. The illumination circuit board 36 is used for providing electric power to the plural light-emitting elements 32, thereby driving the plural light-emitting elements 32. In this embodiment, the plural light-emitting elements 32 are side-view light-emitting diodes, and the illumination circuit board 36 is a flexible circuit board. Alternatively, in some other embodiments, the illumination circuit board is a printed circuit board.

Please refer to FIG. 4 again. The membrane switch circuit member 34 is disposed under the plural keys 30. When the membrane switch circuit member 34 is triggered by the plural elastic elements 303 of the plural keys 30, plural key signals are correspondingly generated. In this embodiment, the membrane switch circuit module 34 comprises an upper wiring board 341, a spacer layer 342 and a lower wiring board 343. The upper wiring board 341 has plural upper contacts 3411. The spacer layer 342 is disposed under the upper wiring board 341, and comprises plural perforations 3421 corresponding to the plural upper contacts 3411. When the membrane switch circuit member 34 is depressed, a corresponding upper contact 3411 is inserted into the corresponding perforation 3421. The lower wiring board 343 is disposed under the spacer layer 342, and comprises plural lower contacts 3431 corresponding to the plural upper contacts 3411. The plural upper contacts 3411, the plural perforations 3421 and the plural lower contacts 3431 are collectively defined as plural key switches 344.

Please refer to FIG. 4 again. From top to bottom, the keycap 301, the scissors-type connecting element 302, the elastic element 303, the membrane switch circuit member 34, the supporting plate 35, the light guide plate 33, the illumination circuit board 36 and the base 31 of the luminous keyboard device 3 are sequentially shown. The plural light-emitting elements 32 are disposed on the illumination circuit board 36. The illumination circuit board 36 is disposed under the light guide plate 33. The plural light-emitting elements 32 are inserted into plural first holes 330 of the light guide plate 33, respectively. The plural light beams B* emitted by the plural light-emitting elements 32 are incident into the light guide plate 33.

Figure 5:
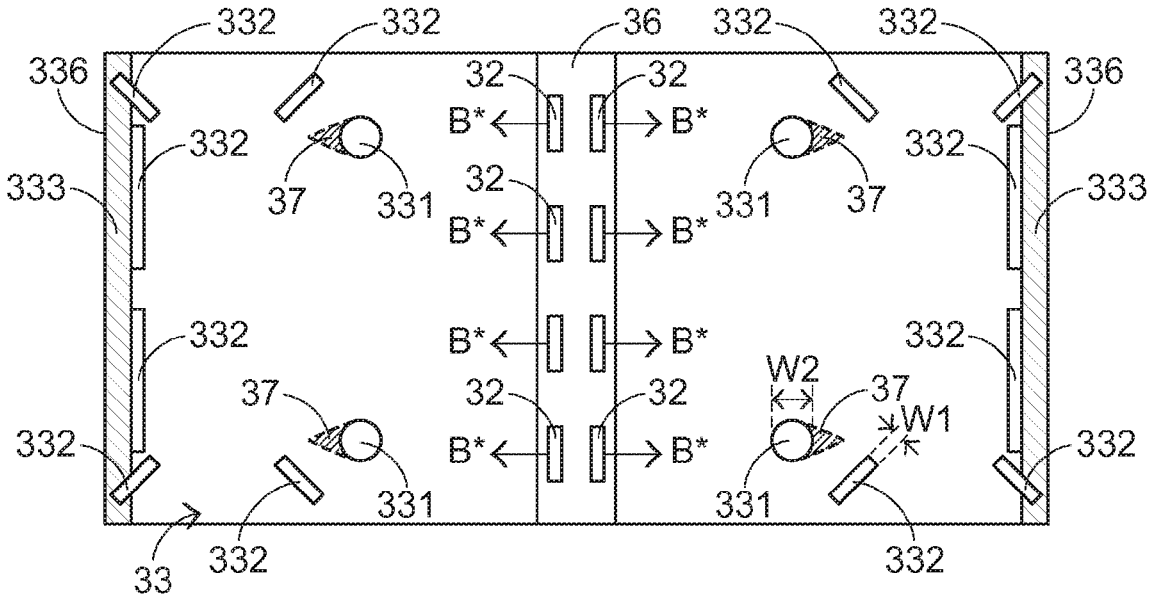
FIG. 5 is a schematic top view illustrating the light guide plate of the luminous keyboard device according to the first embodiment of the present invention.

Hereinafter, the structure of the light guide plate 33 will be illustrated in more details with reference to FIGS. 4 and 5. FIG. 5 is a schematic top view illustrating the light guide plate of the luminous keyboard device according to the first embodiment of the present invention. In addition to the first holes 330, the light guide plate 33 further comprises plural second holes 331, plural elongated slots 332, plural light-absorbing parts 333, plural light-guiding parts 334, and a reflecting part 335. The second holes 331 are aligned with the fixing structures 311, respectively. The fixing structures 311 are penetrated through the corresponding second holes 331. In this embodiment, the second holes 331 are fixing holes for fixing the light guide plate 33 on the base 31. The plural elongated slots 332 are distributed over the light guide plate 33. After the plural light beams B* transferred within the light guide plate 33 are transmitted through the elongated slots 332, the plural light beams B* are departed from the light guide plate 33. In this embodiment, some of the elongated slots 332 are located near a lateral edge 336 of the light guide plate 33, and some of the elongated slots 332 are located near the second holes 331.

The plural light-absorbing parts 333 are located at the lateral edge 336 of the light guide plate 33, and disposed on a bottom surface 337 and a top surface 338 of the light guide plate 33. The plural light-absorbing parts 333 are used for absorbing the plural light beams B* that are incident into the lateral edge 336 of the light guide plate 33. The plural light-guiding parts 334 are disposed on the bottom surface 337 of the light guide plate 33, and aligned with the plural light-outputting zones 3011 of the plural keys 30, respectively. The plural light-guiding parts 334 are used for guiding the plural light beams B* to be directed upwardly to the plural light-outputting zones 3011 of the plural keys 30. The reflecting part 335 is disposed on the bottom surface 337 of the light guide plate 33 for reflecting the plural light beams B*, so that the plural light beams B* are directed upwardly. In this embodiment, the light-absorbing parts 333 are produced by printing light-absorbing ink on the bottom surface 337 and the top surface 338 of the light guide plate 33. Moreover, the plural light-guiding parts 334 are V-cut microstructures, and the reflecting part 335 is a reflective ink layer. Alternatively, in some other embodiments, the light-absorbing parts are only disposed on either the bottom surface or the top surface of the light guide plate.

Figure 6:
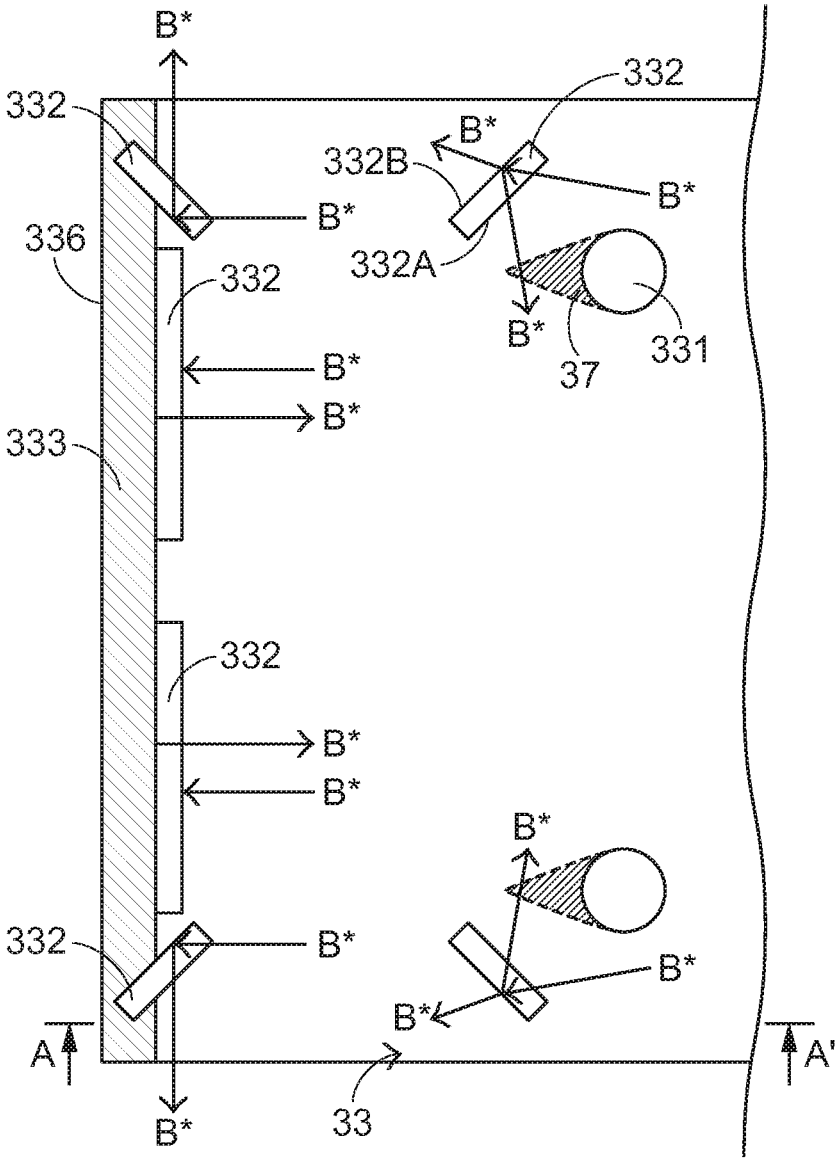
FIG. 6 is a schematic enlarged top view illustrating a portion of the light guide plate of the luminous keyboard device according to the first embodiment of the present invention.

FIG. 6 is a schematic enlarged top view illustrating a portion of the light guide plate of the luminous keyboard device according to the first embodiment of the present invention. Please refer to FIGS. 5 and 6. After the plural light-emitting elements 32 are driven to emit the plural light beams B*, the plural light beams B* are directed to the light guide plate 33, and the plural light beams B* are transferred within the light guide plate 33. After the light beams B* are transferred to one of the plural second holes 331, a portion of the light beams B* are transmitted through the second hole 331 and departed from the light guide plate 33 through a first rim of the second hole 331, and another portion of the light beams B* are transmitted through the second hole 331 and incident into the light guide plate 33 again through a second rim of the second hole 331. The light amount of the portion of the light beams B* which are departed from the second hole 331 is much higher than the light amount of the portion of the light beams B* which are incident into the light guide plate 33 again. Meanwhile, since the great portion of the light beams B* are departed from the light guide plate 33, a shadow region 37 is created at the position near the second hole 331.

After the light beams B* are transferred to the elongated slot 332 near the second hole 331, a portion of the light beams B* are transmitted through the elongated slot 332 and departed from the light guide plate 33 through a first rim 332A of the elongated slot 332, and another portion of the light beams B* are transmitted through the elongated slot 332 and reflected by a second rim 332B of the elongated slots 332 (i.e. a sidewall of the light guide plate 33). The reflected portion of the light beams B* are incident into the light guide plate 33 again, and directed to the corresponding shadow region 37. Consequently, the shadow region 37 is eliminated. In other words, the keys 30 of the luminous keyboard device 3 can be uniformly illuminated. It is noted that the incidence angle of the light beams B* incident to the second rim 332B of the elongated slot 332 is equal to the reflection angle of the light beams B* departed from the second rim 332B of the elongated slot 332 during reflection of the light beams B*. When the light beams B* are incident to the elongated slot 332 near the second hole 331 at a specified incidence angle, the light beams B* can be reflected by the elongated slot 332, and thus the light beams B* can be precisely projected to the shadow region 37 is eliminated.

In this embodiment, the width W1 of each elongated slot 332 of the light guide plate 33 is smaller than the width W2 of each second hole 331 of the light guide plate 33. That is, according to the special design, the width W1 of the elongated slot 332 is smaller than the width W2 of the second hole 331. Since the width W1 of the elongated slot 332 is smaller, the light amount of the portion of the light beams B* which are departed from the light guide plate 33 is reduced. Under this circumstance, the light amount of the portion of the light beams B* which are reflected to the shadow regions 37 is correspondingly increased. Alternatively, in some other embodiments, one elongated slot may be located near plural second holes, wherein the width of the elongated slot may be equal to or larger than the width of the second hole. Under this circumstance, when the light beams are transferred to the plural second openings, a larger shadow region is created by the plural second holes collaboratively. In other words, the width of the elongated slot may be varied according to the practical requirements.

Figure 7:
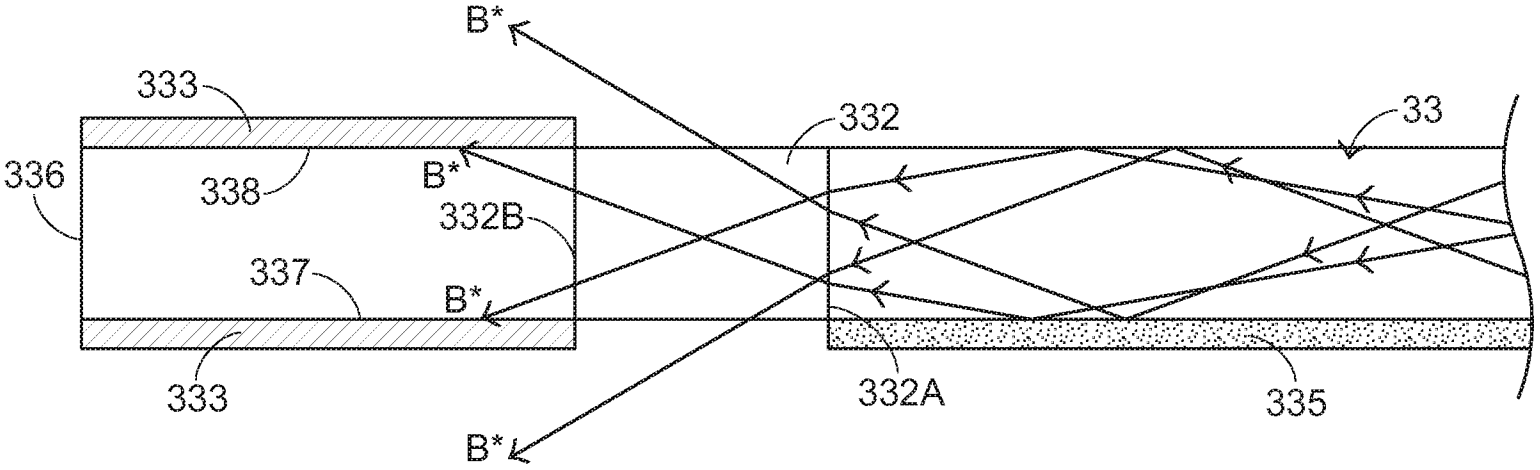
FIG. 7 is a schematic cross-sectional view illustrating the light guide plate of the luminous keyboard device of FIG. 6 and taken along the line A-A'.

Hereinafter, the relationships between the elongated slots 332 near the lateral edge 336 of the light guide plate 33 and the light beams B* will be illustrated with reference to FIGS. 6 and 7. FIG. 7 is a schematic cross-sectional view illustrating the light guide plate of the luminous keyboard device of FIG. 6 and taken along the line A-A'. After the light beams B* are transferred to the elongated slot 332 near the lateral edge 336 of the light guide plate 33, a portion of the light beams B* are transmitted through the elongated slot 332 and reflected by a second rim 332B of the elongated slot 332 (i.e. a sidewall of the light guide plate 33). Under this circumstance, since the projecting direction of the light beams B* is changed, the light beams B* are prevented from being incident into the lateral edge 336 of the light guide plate 33 (see FIG. 6). After the projecting direction of the light beams B* is changed, the light beams B* are introduced into the light guide plate 33 again, and the light beams B* are guided by the plural light-guiding parts 334 to be directed to the plural light-outputting zones 3011 of the plural keys 30. Consequently, the utilization efficiency of the light beams B* will be enhanced. As shown in FIG. 6, another portion of the light beams B* are transmitted through the elongated slot 332 and departed from the light guide plate 33 through a first rim 332A of the elongated slot 332. Consequently, the light beams B* are also prevented from being incident into the lateral edge 336 of the light guide plate 33.

Although a great portion of the light beams B* are transmitted through the elongated slot 332 and departed from the light guide plate 33, a small portion of the light beams B* are transmitted through the elongated slot 332 and incident into the lateral edge 336 of the light guide plate 33 through a second rim 332B of the elongated slot 332. When the small portion of the light beams B* are transferred within the lateral edge 336 of the light guide plate 33 and projected onto the light-absorbing parts 333 on the top surface 338 and the bottom surface 337 of the light guide plate 33, the light beams B* are absorbed by the light-absorbing parts 333. Since the light beams B* are transferred within the lateral edge 336 of the light guide plate 33 are all absorbed by the light-absorbing parts 333, the light beams B* will not be leaked out through the lateral edge 336 of the light guide plate 33. Consequently, the lateral light leakage of the light guide plate 33 can be avoided.

Please refer to FIG. 6 again. The light beams B* are incident to the elongated slot 332 near the second hole 331 at an incidence angle of about 45 degree. Due to this incidence angle, the light beams B* can be reflected by the elongated slot 332, and the light beams B* can be directed to the shadow region 37 to eliminate the shadow region 37. The angle between the elongated slot 332 near the lateral edge 336 of the light guide plate 33 and the lateral edge 336 of the light guide plate 33 is 45 degrees or 0 degree. The 45-degree elongated slot 332 may change the projecting direction of the light beams B*. Under this circumstance, the projecting direction of the light beams B* is in parallel with the lateral edge 336 of the light guide plate 33, and thus the light beams B* can not be incident into the lateral edge 336 of the light guide plate 33. The 0-degree elongated slot 332 may change the projecting direction of the light beams B*. Under this circumstance, the projecting direction of the light beams B* is perpendicular to the lateral edge 336 of the light guide plate 33, and thus the light beams B* are directed toward the light-emitting elements 32.

From the above discussions, the uses of the elongated slots 332 can reduce the light amount of the light beams B* which are introduced into the light guide plate 33. Even if a small portion of the light beams B* are incident into the lateral edge 336 of the light guide plate 33, the light beams B* are absorbed by the light-absorbing parts 333. Consequently, the light beams B* are prevented from being leaked out through the lateral edge 336 of the light guide plate 33.

Figure 8:
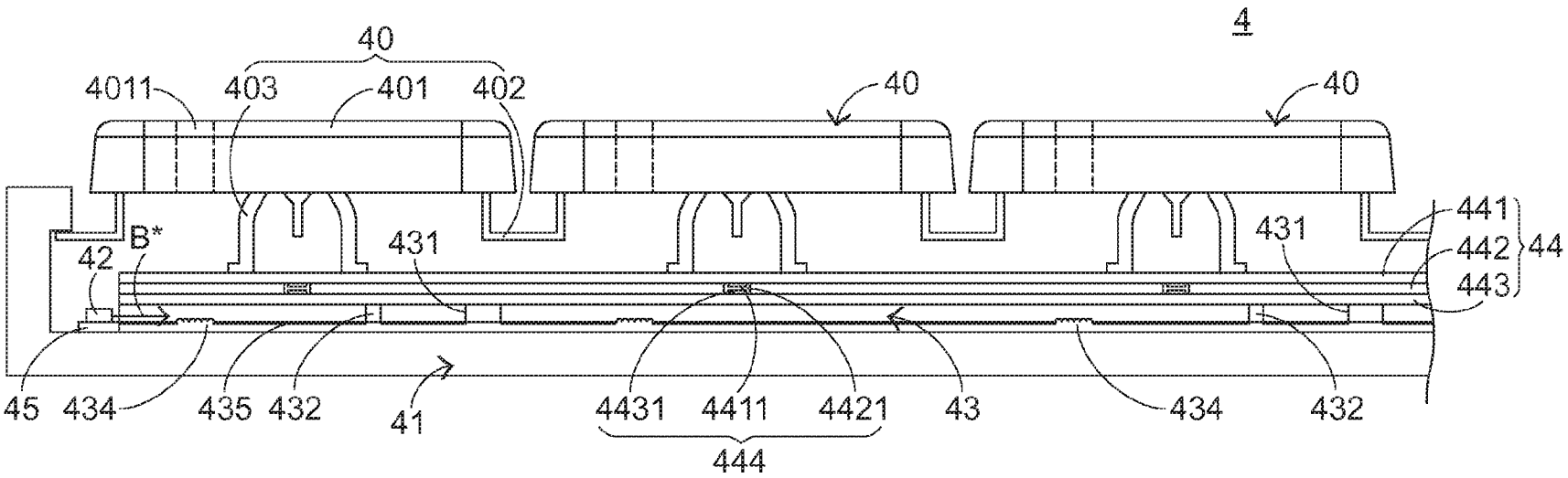
FIG. 8 is a schematic cross-sectional view illustrating a luminous keyboard device according to a second embodiment of the present invention.

The present invention further provides a luminous keyboard device according to a second embodiment of the present invention. FIG. 8 is a schematic cross-sectional view illustrating a luminous keyboard device according to a second embodiment of the present invention. As shown in FIG. 8, the luminous keyboard device 4 comprises plural keys 40, a base 41, plural light-emitting elements 42, a light guide plate 43, a membrane switch circuit member 44, and an illumination circuit board 45. For clarification and brevity, only one light-emitting element 42 is shown in the drawing. The membrane switch circuit module 44 comprises an upper wiring board 441, a spacer layer 442 and a lower wiring board 443. The upper wiring board 441 has plural upper contacts 4411. The spacer layer 442 comprises plural perforations 4421 corresponding to the plural upper contacts 4411. The lower wiring board 443 is disposed under the spacer layer 442, and comprises plural lower contacts 4431 corresponding to the plural upper contacts 4411. The plural upper contacts 4411, the plural perforations 4421 and the plural lower contacts 4431 are collectively defined as plural key switches 444. The light guide plate 43 comprises plural holes 431, plural elongated slots 432, a light-absorbing part (not shown), plural light-guiding parts 434, and a reflecting part 435.

Except for the following four items, the structures and the operations of the luminous keyboard device 4 of this embodiment are substantially identical to those of the luminous keyboard device 3 of the first embodiment, and are not redundantly described herein.

Firstly, each key 40 comprises a keycap 401, a key housing 402, and an elastic element 403. The key housing 402 is arranged between the base 41 and the keycap 401 for supporting the keycap 401. Since it is not necessary to connect the key housing 402 with a supporting plate, the supporting plate is not included in the luminous keyboard device 4. That is, the luminous keyboard device 4 of this embodiment is an external keyboard device, and the base 41 is not installed on a notebook computer. Secondly, the plural light-emitting elements 42 are disposed on the illumination circuit board 45, and the illumination circuit board 45 is located at a side of the light guide plate 43. That is, the plural light-emitting elements 42 are located at the side of the light guide plate 43. From top to bottom, the keycap 401, the scissors-type connecting element 402, the elastic element 403, the membrane switch circuit member 44, the light guide plate 43 and the base 41 of the luminous keyboard device 4 are sequentially shown in FIG. 8. Thirdly, the plural light-guiding parts 434 of the light guide plate 43 are texturing structures. Alternatively, the plural light-guiding parts 434 may be light-guiding ink layers. Fourthly, the holes of the light guide plate 43 are ventilation holes rather than the fixing holes. In other words, the base 41 has no fixing structures corresponding to the plural fixing holes. Alternatively, in some other embodiments, the plural holes of the light guide plate are sound holes.

From the above descriptions, the present invention provides a luminous keyboard device. In the luminous keyboard device, plural elongated slots are formed in a light guide plate. Some of the elongated slots are located near a lateral edge of the light guide plate, and some of the elongated slots are located near the fixing holes of the light guide plate. After the light beams are transferred to the elongated slots near the fixing holes, a portion of the light beams are reflected to the shadow regions near the fixing holes. Consequently, the shadow regions are eliminated, and the keys of the luminous keyboard device can be uniformly illuminated. On the other hand, after the light beams are transferred to the elongated slot near the lateral edge of the light guide plate, a great portion of the light beams are transmitted through the elongated slot and departed from the light guide plate, and only a small portion of the light beams are introduced into the lateral edge of the light guide plate. After the light beams are introduced into the lateral edge of the light guide plate, the light beams are absorbed by the light-absorbing parts, which are located at the lateral edge of the light guide plate. Consequently, the lateral light leakage of the light guide plate can be avoided.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A luminous keyboard device, comprising:

a base;

plural keys disposed over said base, and exposed outside a top surface of said luminous keyboard device, wherein each of said keys comprises a light-outputting zone;

at least one light-emitting element arranged between said base and said plural keys for emitting at least one light beam; and a light guide plate disposed on said base and located at a side of said at least one light-emitting element for guiding said at least one light beam to said plural light-outputting zones of said plural keys, wherein said light guide plate comprises:

plural holes;

plural elongated slots located near a lateral edge of said light guide plate, wherein after said light beam is transferred within said light guide plate and transferred to said elongated slots, a portion of said light beam is transmitted through said elongated slots and departed from said light guide plate; and at least one light-absorbing part located at said lateral edge of said light guide plate, wherein when said light beam is incident into said lateral edge of said light guide plate, said light beam is absorbed by said light-absorbing part.

2. The luminous keyboard device according to claim 1, wherein said base comprises plural fixing structures, and said plural holes of said light guide plate are aligned with said plural fixing structures, wherein said plural fixing structures are penetrated through corresponding holes, respectively, so that said light guide plate is fixed on said base.

3. The luminous keyboard device according to claim 1, wherein said plural holes are ventilation holes or sound holes, and said at least one light-absorbing part is a light-absorbing ink layer.

4. The luminous keyboard device according to claim 1, wherein at least one elongated slot of said plural elongated slots is located near a corresponding hole, wherein after said at least one light beam is transmitted through said hole, a shadow region is formed at a position near said hole, wherein after said at least one light beam is transmitted through said elongated slot near said hole, a portion of said at least one light beam is directed to said shadow region.

5. The luminous keyboard device according to claim 4, wherein when said at least one light beam is incident to at least one elongated slot of said plural elongated slots near a corresponding hole at an specified incidence angle, said at least one light beam is transmitted through said elongated slot and reflected to said shadow region.

6. The luminous keyboard device according to claim 1, wherein said light guide plate further comprises:

plural light-guiding parts disposed on a bottom surface of said light guide plate for guiding said at least one light beam to be directed upwardly to said plural light-outputting zones of said plural keys; and a reflecting part disposed on said bottom surface of said light guide plate for reflecting said at least one light beam upwardly.

7. The luminous keyboard device according to claim 6, wherein said plural light-guiding parts are V-cut microstructures, texturing structures or light-guiding ink layers, and said reflecting element is a reflective ink layer.

8. The luminous keyboard device according to claim 1, further comprising a membrane switch circuit member, which is disposed under said plural keys, wherein when said membrane switch circuit member is triggered by said plural keys, plural key signals are correspondingly generated, wherein said membrane switch circuit member comprises:

an upper wiring board having plural upper contacts;

a spacer layer disposed under said upper wiring board, and having plural perforations corresponding to said plural upper contacts, wherein when said membrane switch circuit module is depressed, a corresponding upper contact is inserted into a corresponding perforation; and a lower wiring board disposed under said spacer layer, and having plural lower contacts corresponding to said plural upper contacts, wherein said plural lower contacts and said plural upper contacts are collectively defined as plural key switches.

9. The luminous keyboard device according to claim 8, further comprising an illumination circuit board, which is located at a side of said light guide plate or disposed under said light guide plate, wherein said at least one light-emitting element is disposed on said illumination circuit board, and said illumination circuit board provides electric power to said at least one light-emitting element.

10. The luminous keyboard device according to claim 1, further comprising a supporting plate for supporting said plural keys, wherein each of said plural keys comprises:

a keycap exposed to said top surface of said luminous keyboard device, wherein said light-guiding zone is formed on said keycap;

a connecting element arranged between said supporting plate and said keycap for connecting said supporting plate and said keycap, and allowing said keycap to be moved upwardly and downwardly relative to said supporting plate; and an elastic element arranged between said membrane switch circuit module and said keycap for providing an elastic force to said keycap, wherein said keycap is returned to an original position in response to said elastic force.

11. The luminous keyboard device according to claim 1, wherein each of said plural keys comprises:

a keycap exposed to said top surface of said luminous keyboard device, wherein said light-guiding zone is formed on said keycap;

a key housing arranged between said supporting plate and said keycap for supporting said keycap; and an elastic element penetrated through said key housing and arranged between said membrane switch circuit module and said keycap for providing an elastic force to said keycap, wherein said keycap is returned to an original position in response to said elastic force.

* * * * *